US005090672A

United States Patent [19]

Ballestrazzi et al.

[11] Patent Number: 5,090,672

[45] Date of Patent: Feb. 25, 1992

[54] AUTOMATIC APPARATUS FOR FOLDING SHEET ELEMENTS

[75] Inventors: Aris Ballestrazzi, Via Castello, 14/1; Lamberto Tassi, Via Castello, 14/2, both of Savignano Sul Panaro, Modena, Italy

[73] Assignee: Sitma S.p.A., Modena, Italy

[21] Appl. No.: 537,084

[22] Filed: Jun. 12, 1990

[30] Foreign Application Priority Data

Jun. 19, 1989 [IT] Italy ..... 20914 A/89

[51] Int. Cl.[5] ..... B42C 1/00

[52] U.S. Cl. ..... 270/45; 493/438; 493/416; 493/460; 270/32

[58] Field of Search ..... 270/32, 45, 51, 58; 493/416, 422, 423, 436, 438, 460, 461

[56] References Cited

U.S. PATENT DOCUMENTS

| | | | |
|---|---|---|---|
| 3,361,425 | 1/1968 | Benitez | 270/45 |
| 4,046,366 | 9/1977 | McCain | 270/32 |
| 4,747,817 | 5/1988 | Newsome | 493/438 |
| 4,784,379 | 11/1988 | Vander Syde | 270/58 |
| 4,875,668 | 10/1989 | Spyra | 270/45 |

FOREIGN PATENT DOCUMENTS

| | | | |
|---|---|---|---|
| 57590 | 3/1966 | Fed. Rep. of Germany | 270/45 |

*Primary Examiner*—Edward K. Look
*Assistant Examiner*—Therese M. Newholm
*Attorney, Agent, or Firm*—Hedman, Gibson & Costigan

[57] ABSTRACT

An automatic apparatus for folding sheet elements fed one after the other in succession, comprising a first unit for U-shaping the sheet elements to define two vertical side portions and a longitudinal central region, a pusher element for V-shaping the central region and a second unit for the final compaction of the V-shaped sheet elements. The apparatus also comprises a third unit for rotating the folded compacted sheet elements leaving the second unit through 90° and elements for separating the parallel side-by-side edges of the thus folded and compacted sheet elements to enable further additional elements to be inserted between them. The speed of the various units is correlated to prevent any deterioration or slippage of the sheet elements.

24 Claims, 5 Drawing Sheets

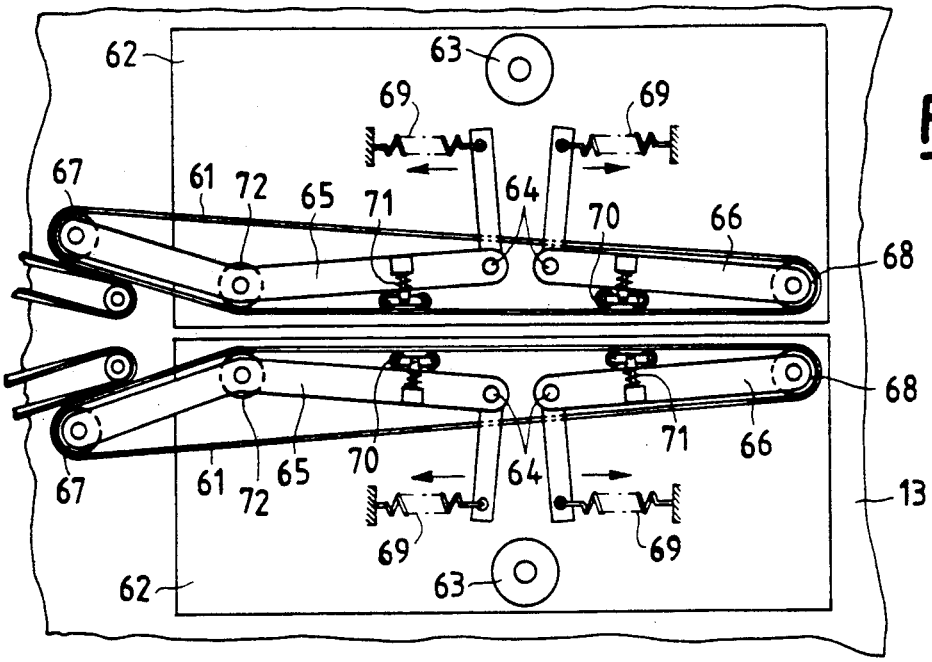
Fig.3
Fig.4
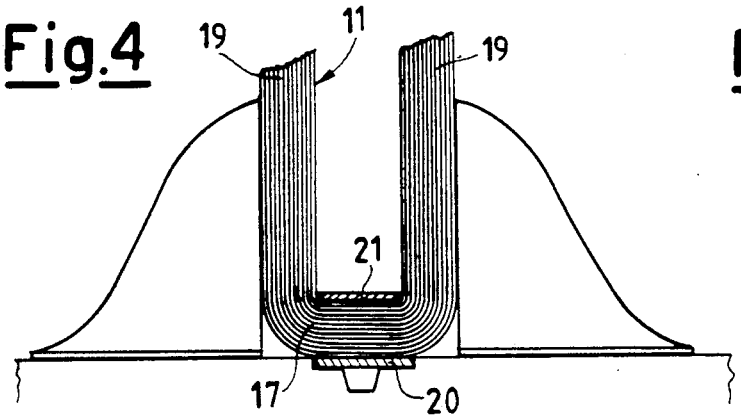
Fig.6
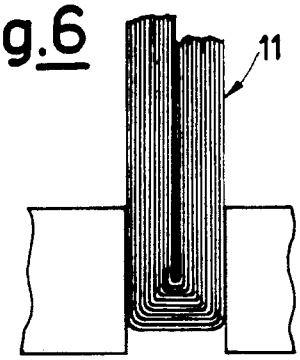
Fig.11
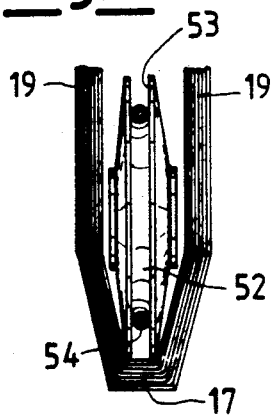
Fig.12
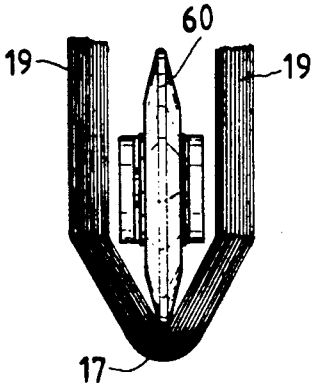

AUTOMATIC APPARATUS FOR FOLDING SHEET ELEMENTS

This invention relates to an automatic apparatus for folding sheet elements.

In this respect, the term "sheet elements" is intended to mean either a single paper sheet or an editorial graphic product. An editorial product in this context means a newspaper, a magazine, or a signature etc. The product can be either a single product or a folded product or a number of superposed single or folded products.

For example, in machines for wrapping said sheet elements in a film of plastics material such as polyethylene or polypropylene, such sheets after leaving the conventional printing and folding machines may have to be fed in a specially folded manner and/or arranged with a determined specific positioning required for their subsequent wrapping.

An object of the present invention is to provide an apparatus able to automatically fold said sheet elements in accordance with the specific requirement and which if required can be arranged directly aligned with the inlet of a product wrapping machine, such as that initially referred to, or be manually or automatically connected downstream of the production process for said sheet elements.

A further object is to provide an apparatus able to fold said sheet elements irrespective of their thickness or the multiple state of their composition.

These and further objects are attained according to the present invention by an automatic apparatus for folding sheet elements fed one after the other in succession along their direction of advancement, characterised by comprising a frame supporting a first shaping unit which forms said sheet elements into U-shape to define two vertical side portions and a longitudinal central region within said sheet elements, said first shaping unit consisting of means for gripping and accompanying said central region, and associated with lateral support and accompanying elements for rotating said two side portions of said sheet elements from a first position in the feed plane to a second position in which they are parallel, separated and side by side, a pusher element for V-shaping said central region, and a second unit for the final compaction of said V-shaped sheet elements and consisting of lateral walls for compressing said central region and retaining elements for accompanying said thus folded sheet elements towards a subsequent station.

The structural and operational characteristics and advantages of an apparatus according to the present invention will be more apparent from the description given hereinafter by way of nonlimiting example with reference to the accompanying drawings, in which:

FIG. 3 is an enlarged plan view of a constituent part of a second unit for compacting the sheet elements of the apparatus of FIG. 1;

FIGS. 4 and 4A are an enlarged detail at an end portion of a first shaping unit with a sheet element such as a newspaper inserted therein.

FIG. 6 is an enlarged detail at an end portion of a second final compaction unit with a sheet element similar to that of FIG. 4 inserted;

FIG. 11 is an enlarged detail showing a sheet element arranged at the pusher element shown in FIG. 9.

FIG. 12 is an enlarged detail showing a sheet element arranged at the pusher element shown in FIG. 10.

Figure 1:
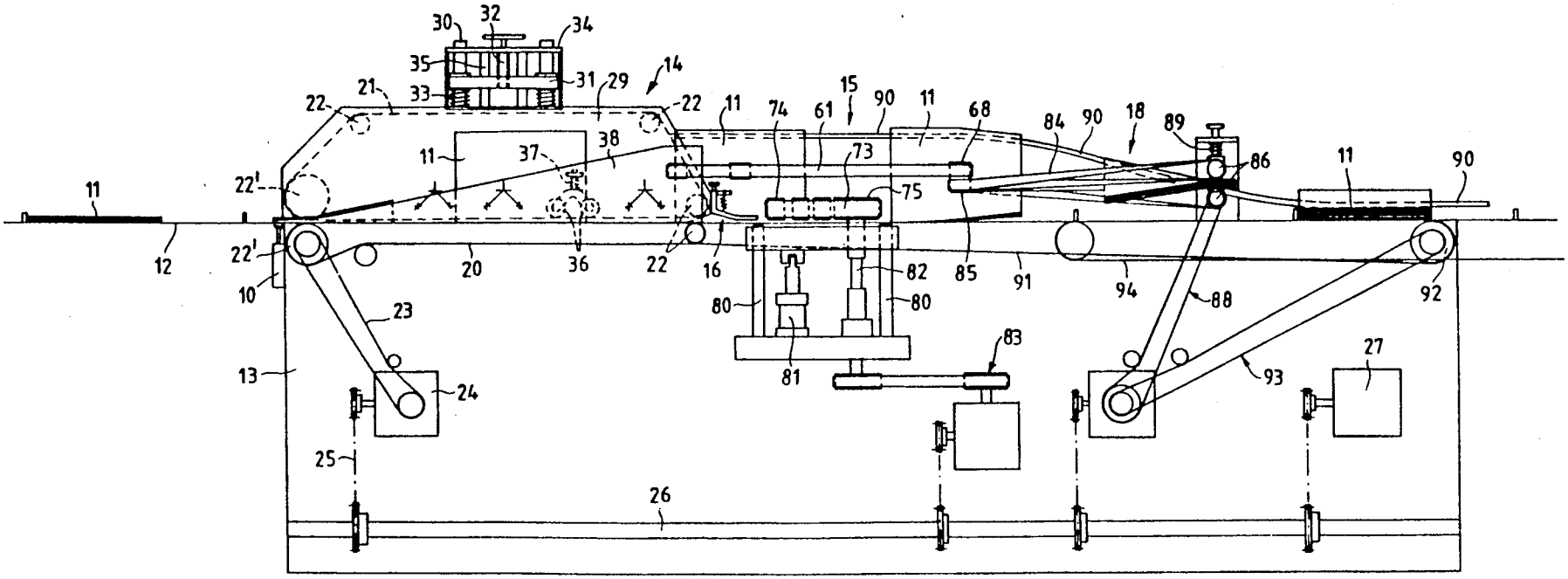
FIG. 1 is a side elevation of an automatic apparatus for folding sheet elements according to the present invention.
Figure 2:
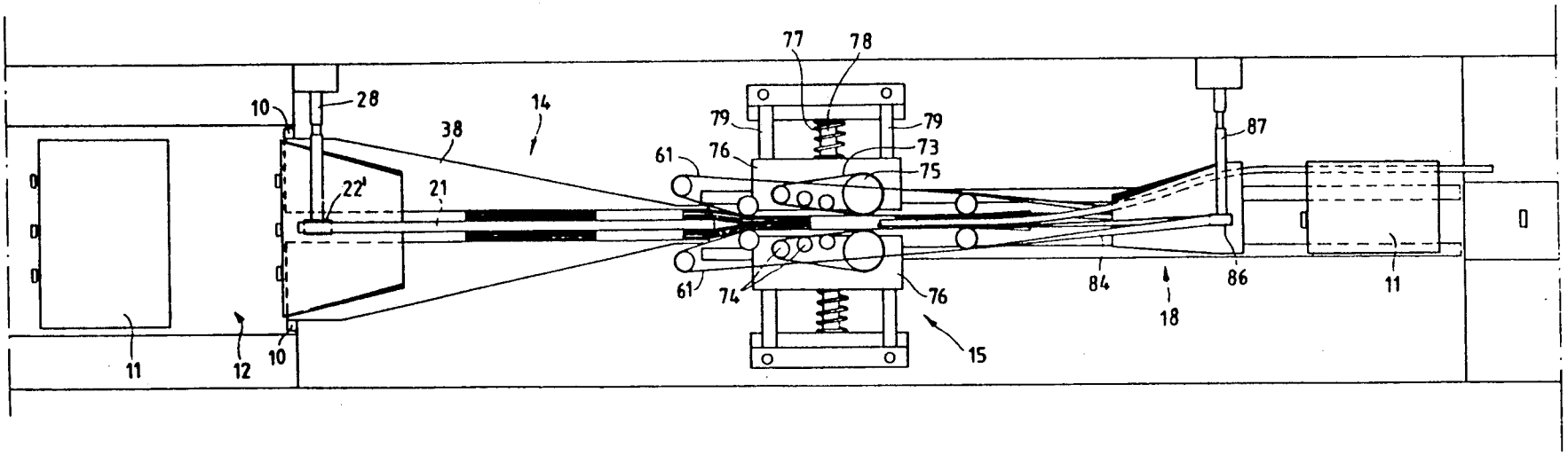
FIG. 2 is a top plan view of the apparatus of FIG. 1.

With reference to FIGS. 1 to 3, an automatic apparatus for folding sheet elements 11 which arrive for example from a printing machine, not shown, and are fed one after the other in succession either in register or not, for example by a push-type conveyor indicated schematically at 12, comprises assentially a frame 13 for supporting a first shaping unit, indicated overall by 14, and a second unit, indicated overall by 15, for the final compaction of the sheet elements. Between said first unit 14 and second unit 15 there is interposed a pusher element indicated overall by 16 for V-shaping a flat central region 17 of the sheet elements 11. A third unit, indicated overall by 18, can also be provided for the 90° rotation of the thus folded sheet elements 11 emerging from the second unit 15.

The first shaping unit 14 shapes the sheet elements 11 into a U with sharp edges (FIG. 4) to define two vertical lateral portions 19 and the longitudinal flat central region 17. Said first shaping unit 14 consists of means for gripping and accompanying the flat central region 17, these means being associated with lateral support and accompanying elements for rotating the two side portions 19 of the sheet elements 11 from a first position in the feed plane of the conveyor 12 to a second position in which they are parallel, separated and side by side (FIG. 4).

Figure 4A:
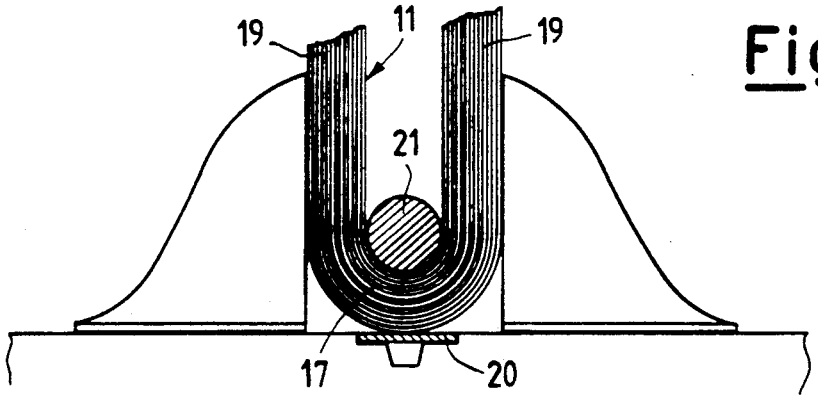

Said means for gripping and accompanying the first shaping unit 14 consist of a pair of conveyors in the form of endless flat guide belts 20 and 21 extending between end pulleys 22, 22'. Said guide belts, which are vertical and mutually facing one above the other, comprise a first lower belt 20 on which the flat central region 17 of the sheet elements 11 rests, and a second upper belt 21 of small transverse dimensions, to be inserted between the two vertical side portions 19 of the sheet elements 11. Alternatively, as shown in FIG. 4A, the second upper belt 21 can be of essentially toroidal form to generate a central portion 17 in the U-shaped sheet elements which does not have sharp edges but which instead smoothly blends into the two vertical side portions 19.

The first lower belt 20 is motorized, for example by a first transmission 23, which rotates the pulley 22' and extends from the output side of a reduction gear 24. The reduction gear 24 is driven by a further transmission 25 from a rigid drive shaft 26 extending longitudinally to the apparatus of the invention and driven by the main motor 27.

The second upper belt 21 is for example motorized by a transmission shaft 28 which drives the drive pulley 22' and is itself driven by the drive for the first lower belt 20 via a gearwheel coupling (not shown) which provides the same speed of advancement to the belts. The second upper belt 21 is arranged on a frame 29 upperly comprising a pair of guide rods 30, which are centrally arranged on it and on which there slides a cross-member 31 adjustable in height by a manually operable adjustment device 32, for example of screw type. Between the cross-member 31 and the top of the frame 29 there are provided, coaxially to the guide rods 30, elastic elements 33 which allow the frame 29 to undergo slight vertical movement so as to adapt the position of the second upper belt 21 to the inserted sheet elements on the first lower belt 20. The adjustment device 32 is rigid with a structure 34 arranged to the side of the first shaping unit 14 and enabling the entire second upper belt 21 to be raised and lowered by vertical actuator cylinders 35.

On the frame 29 in a position corresponding with the lower part of the second upper belt 21 which faces said first lower belt 20 there are provided guide rollers 36, which are supported on the frame 29 via elastic elements 37. The provision of these latter guide rollers 36 allows the lower portion of the belt 21 to be adapted to the individual sheet elements 11 fed one after the other and contained within it.

The lateral support and accompanying elements for the rotation of the two side portions 19 of the sheet elements 11 shown in FIGS. 1 and 2 are fixed guides 38 which face each other and are positioned on opposite sides of said gripping and accompanying means or rather of said second upper belt 21, and in addition are mutually specular and are of helix shape to rotate the two side portions 19 of the sheet elements 11 through 90°. At their front, said fixed guides 38 can be supported on the ends of the rods of cylinders 10 which enable the guides to be raised to if necessary allow the passage of extended open sheet elements between the belts 20 and 21.

Figure 5:
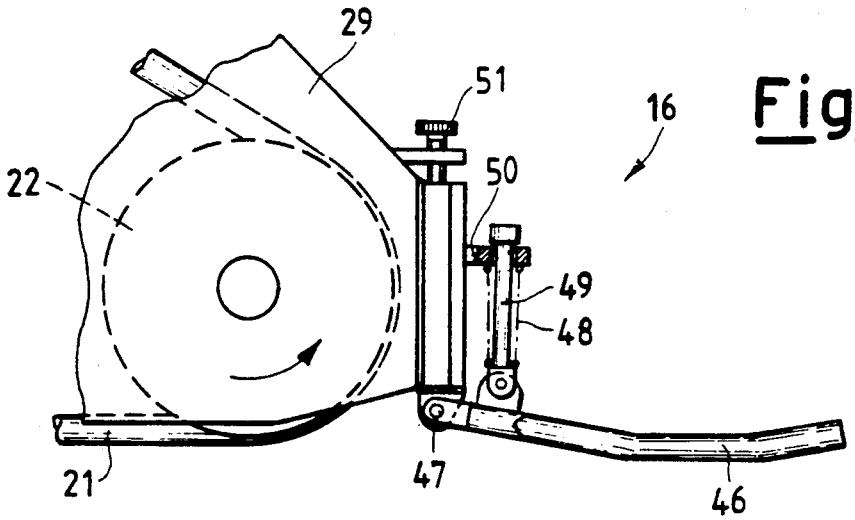
FIG. 5 is an enlarged side elevation of a pusher element for V-shaping the sheet element.

The speeds of the lower belt 20 and upper belt 21 are maintained suitably equal and correlated to obtain correct transport both of single products and in particular of several superposed products. FIG. 5 shows an embodiment of the pusher element 16 for V-shaping the sheet element, and consisting of a guide rod 46 pivoted at one end, at 47, to the support frame 29 for the second upper belt 21 and forming part of the gripping and accompanying means of the first shaping unit 14. The guide rod 46 is kept essentially horizontal by an elastic downwardly-urging element 48 coaxially arranged on a pivot 49 and reacting against an appendix 50 jutting from the frame 29.

The entire pusher element 16 can be moved vertically relative to the frame 29 by elements for its vertical position adjustment, for example by an adjustment screw shown schematically at 51. Alternatively the vertical height adjustment of the pusher element 16 could be accomplished automatically by a suitable actuator means (not shown).

The second unit for the final compacting of the sheet elements 11, indicated by 15, is arranged at the exit of the first shaping unit 14 and receives the sheet elements already V-shaped (as shown for example in FIGS. 11 and 12). The second unit 15 consists essentially of lateral elements for compressing said already V-shaped central region 17, and retaining and accompanying elements for said thus folded sheet elements which act on the vertical side portions 19 of the sheet elements 11.

The lateral retaining and accompanying elements consist of a pair of belts 61 which face each other horizontally at the sides of the two vertical side portions 19 of the sheet elements 11, and are disposed on two support plates 62 which are rigid with the apparatus framework 13 but are adjustable in height by a screw with a handwheel indicated schematically by 63. A pair of essentially L-shaped front levers 65 and rear levers 66 are pivoted at 64, on a vertical axis, on each of said support plates 62 approximately in proximity to the edge facing the other plate and centrally thereto, so that the two minor sides of the L are side by side. Each of said front and rear levers 65 and 66 rotatably carries a deviation pulley 67 and 68 respectively, at that free end distant from the major side of the L. The other end of said L-shaped levers 65 and 66 is connected to elastic elements 69 which urge the two side-by-side minor sides of the levers apart, to consequently cause the deviation pulleys 67 and 68 and the belts 61 to approach the centre of the second unit 15 in a direction transverse to the apparatus, i.e. to approach the folded sheet elements contained in this latter unit.

An end region of the front levers 65 is V-shaped and open towards the first shaping unit 14 to at least partly embrace it laterally. This open-V end region is defined by at least one further idle guide roller 72 for the belts 61. In positions corresponding with the major sides of the front and rear levers 65 and 66 there are provided for the belts 61 further mutually facing idle guide rollers 70 carrying associated elastic elements 71 which make them yieldably supported on the levers 65 and 66.

The lateral compressing elements of the second unit 15 consist of a further pair of belts 73 which essentially face each other horizontally but diverge in V form towards the pusher element 16. The belts 73 extend endlessly about an idle end pulley 74 and a motorized end pulley 75 respectively. Further intermediate idle pulleys 74 are provided acting on the facing portions of the belts 73. All the pulleys 74 and 75 are pivoted vertically on a pair of slides 76 which are maintained in their correct adjacent position by elastic elements 77 coaxially pivoted on a column 78. The slides 76 can move horizontally along guide shafts 79 and vertically along guide columns 80, there being provided for example an actuator means such as a piston 81 for the vertical movement. The motorized pulleys 75 are driven via a splined shaft coupling 82 rotated by a transmission 83, this latter being driven by the said drive shaft 26.

The total compression of the central region 17 of the sheet elements 11, as shown in FIG. 6, occurs gradually during their passage within the open-V portion of the belts 73 and then between the motorized end pulleys 75, which are nearly in mutual engagement. As stated, at the exit of said second unit there is provided a third unit 18 for rotating the sheet elements 11 through 90° and consisting of second lateral longitudinal retaining and accompanying elements for said sheet elements 11. The second retaining and accompanying elements are a final pair of belts 84 which engage an intermediate region of said vertical side portions 19 of said sheet elements 11. One end of said final pair of belts 84, also endless, is aligned with the exit of the first retaining and accompanying elements represented by the belts 61, the other end being rotated helically through 90° so that the sheet elements 11 are also rotated through 90° during their conveying from one end to the other, this rotation being possible in one direction or the other as required.

The belts 84 pass at one end about pulleys 85 axially aligned with the pulleys 68, whereas at their other end they pass about motorized pulleys 86 driven by shafts 87 rotated by a transmission 88, which is also driven by the drive shaft 26.

The upper pulley 86, rotating about a horizontal axis, can be moved vertically against yieldable elastic elements 89. Coupling the pulleys 68 and 85 on the same shaft means that the transmission 88 drives not only the belts 84 of the third unit 18 but also the preeceding belts 61 of the second unit 15. Elements 90 for separating the adjacent upper parallel end edges of the two side portions 19 of the sheet elements 11 are associated with both said first and said second longitudinal lateral retaining and accompanying elements 61 and 84. Said separator elements 90 are for example in the form of a narrow continuous plate extending vertically along the second unit 15, then twisted as a parallel helix axially interposed between the belts 84 of the third unit 18 and then extending horizontally along the further travel of the sheet elements 11, to keep their side portions 19 permanently separated.

Associated with the first lower belt 20 and extending from it along both the second unit 15 and the third unit 18 there is a conveyor element 91, also consisting for example of a pair of endless belts passing at one end about pulleys coaxial to the pulley 22 and motorized at their other end by end pulleys 92. This motorization is provided by a transmission 93, which can be in partial relationship with the transmission 88 and also derives from the drive shaft 26.

A second conveyor 94, of pusher type, is provided between said two belts 91 to expel the correctly folded sheet elements 11 leaving the third unit 18 and possibly comprising side portions 19 kept separated by the separator elements 90.

Figure 7:
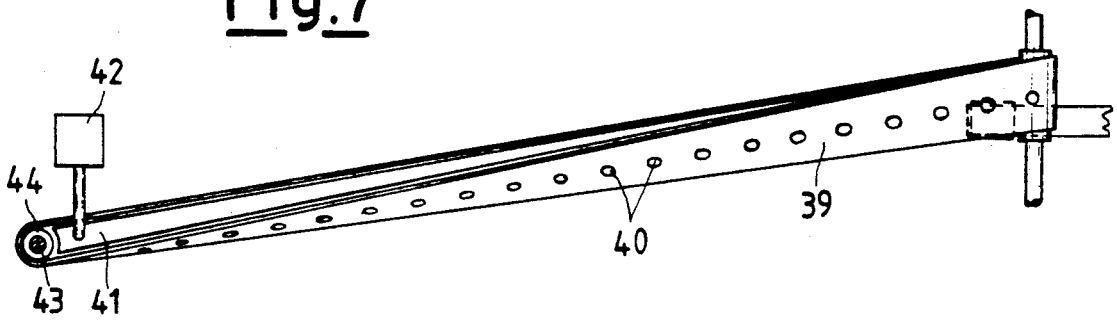
FIG. 7 is an enlarged detail of a second embodiment of the lateral support and accompanying elements of the first sheet element shaping unit.
Figure 8:
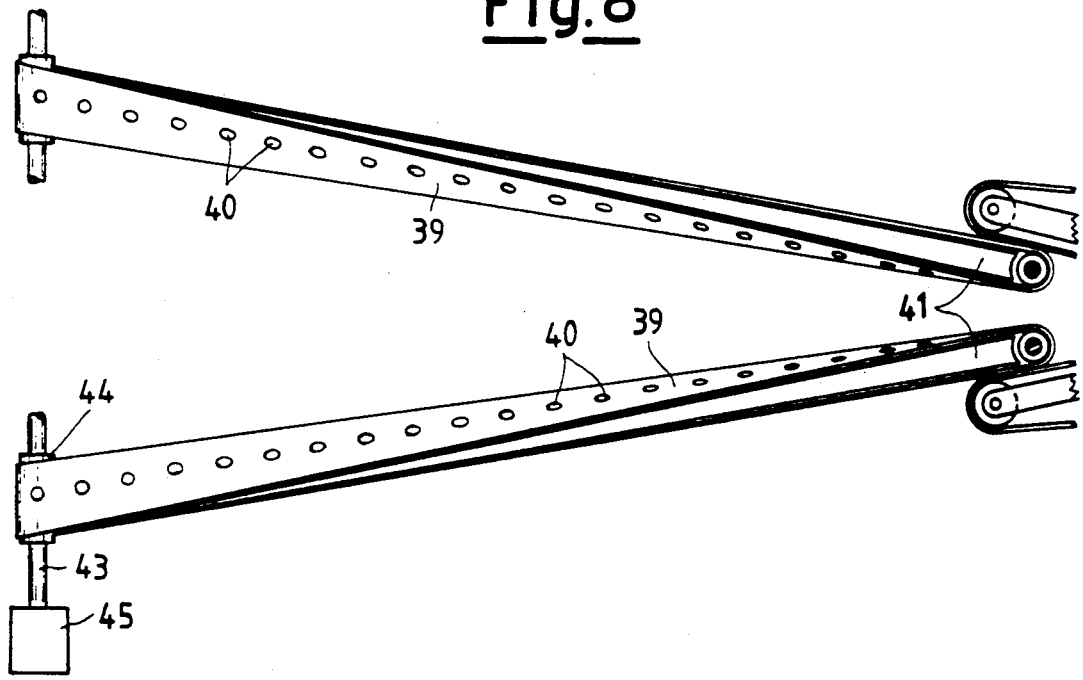
FIG. 8 is a top plan view of FIG. 7.

FIGS. 7 and 8 show a second alternative embodiment of the lateral support and accompanying elements of the first shaping unit 14. In this embodiment the lateral elements consist of endless conveyor belts 39 also facing each other specularly on opposite sides of the gripping and accompanying means and arranged to form a portion of a helix. It is interesting to note that the speed of said conveyor belts must exceed that of the gripping and accompanying means represented by the upper and lower belts 21 and 20, because these latter undergo a linear movement whereas the former travel through a greater distance likeable to a diagonal.

With reference to FIGS. 7 and 8 a further embodiment can be provided by way of example in which the conveyor belts 39 comprise a plurality of holes 40 in their surface and are slidable, along their facing specular portion, on box elements 41 operationally connectable to a pump for creating vacuum and schematically indicated by 42. In that surface facing the interior of the first separator unit these box elements also comprise a plurality of holes (not shown) by which, in combination with the plurality of holes 40 provided in the conveyor belts, they retain the side portions 19 of the sheet elements 11, especially when these sheet elements are light and consist for example of a single sheet. Motorization of the conveyor belts 39 in both these latter embodiments can be advantageously obtained by shafts 43 emerging from an end pulley 44 and connected for example to the drive of the second upper belt 21 by way of a suitable speed reduction or variation gear indicated schematically by 45.

Figure 9:
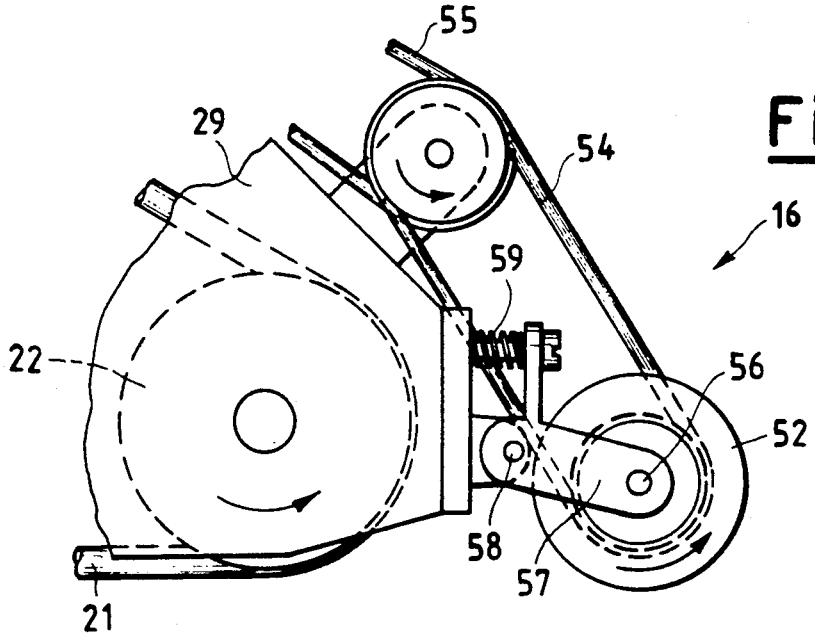
FIG. 9 is an enlarged side elevation of a second embodiment of a pusher element for shaping the sheet element.
Figure 10:
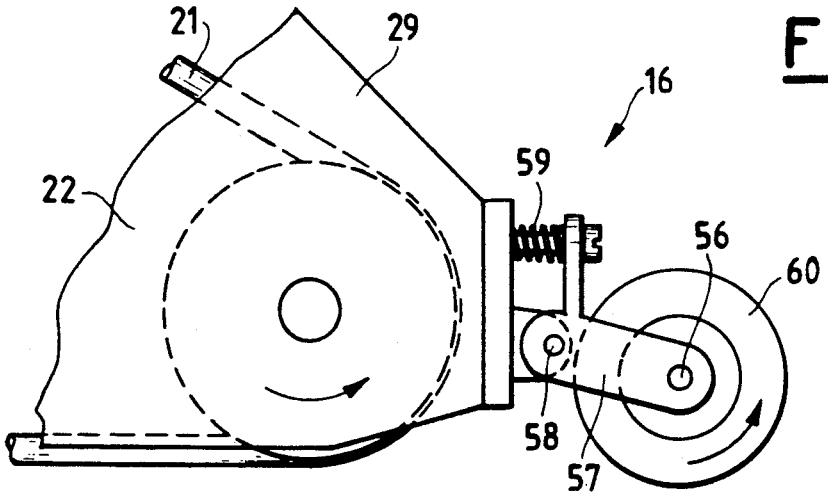
FIG. 10 is an enlarged side elevation of a third embodiment of a pusher element for shaping the sheet element.

FIGS. 9 and 11 show a second embodiment of the pusher element 16 in which this latter consists of a wheel 52 comprising a central groove 53 in which a belt 54 is inserted to rotate it by means of a motorized transmission indicated overall by 55 and partly shown. The wheel 52 is pivoted at 56 on one end of a support bar 57, which is pivoted at 58 to the frame 29. The support bar 57 is of right angled shape and is urged at its other end downwards and away from said frame 29 by an elastic element 59. In this manner (FIG. 11), the wheel 52 is kept in contact with the central region 17 of the sheet elements 11 to form it into V-shape. FIGS. 10 and 12 show a third embodiment of the pusher element, which is identical to that just described with the exception that in this case the roller 60 is idle. FIG. 12 shows how again in this case the idle roller 60 interferes with the central region 17 to form it into V-shape. In the examples represented in FIGS. 9 to 12 the vertical height adjustment device for the pusher element 16 has been omitted for simplicity, but it could be provided. The operation of an automatic apparatus for folding sheet elements according to the present invention is as follows.

The sheet elements 11, which in the described example illustrated in the figures are newspapers, are fed by the conveyor 12 into the apparatus according to the invention. An individual sheet element 11 enters the first shaping unit 14 between the upper band 21 and lower band 20 at the drive pulleys 22' and is retained and dragged along by these. The side portions 19 slide guidedly on the fixed guides 38 or belts 39, and because of the particular shape of these latter are displaced from their first horizontal feed position to a second vertical position shown in FIG. 4.

The elastic elements 33 and yieldable idle rollers 36 enable the upper belt 21 to move vertically to adapt to the thickness of the advancing sheet element 11.

On leaving the first shaping unit 14 the U-folded sheet element 11 or rather its central region 17 comes into contact with the pusher element 16 which V-shapes it as shown in FIG. 11 or 12. During this first stage of V-shaping, the side portions 19 of the sheet element 11 are retained and accompanied by the belts 61 of the second apparatus unit 15.

When its V-shaping is complete the central region 17 is fed within the bands 73 forming part of the lateral compression elements until it finally emerges compressed as shown in FIG. 6 at the motorized end pulleys 75. The sheet element 11 is then accompanied by the belts 61 to the third unit which, arranged to correspond with the middle of the side portions 19 of the sheet element 11, grips it and conveys it, to rotate it through 90° by the time it reaches the exit of said third unit. The sheet element 11, now folded as required, then leaves the third unit to lie on the outlet conveyor element 91, to be expelled by the second pusher conveyor 94.

As the sheet element 11 passes through the second and third units of the apparatus, the upper separator element 90 enables the upper edges of the side portions 19 of said sheet element to be kept separated for the possible insertion of additional sheets. An apparatus according to the present invention allows completely automatic folding of any sheet element, a perfect shaping of the fold irrespective of the thickness of the sheet element concerned and, by possible rotation, the emergence of the folded sheet in any predetermined required arrangement.

In an apparatus according to the invention, by raising the upper belt 21 together with its frame 29, the pusher element 16 and the guides 38, and lowering the lateral compression elements in the form of the belt 73, sheet elements can pass through the entire apparatus in the same arrangement as that in which they are fed, without undergoing any folding.

In an apparatus according to the present invention it should be noted that by operating the belts 20 and 21, the pair of belts 61, the further pair of belts 73 and the final pair of belts 84 at the same speed, the sheet elements travel securely between them without any deterioration on slippage, deterioration being particularly important in the case of printed or particularly delicate sheet elements and slippage being important in the case of superposed or composite sheet elements.

We claim:

1. A device for folding sheets fed in a stream, wherein the device has a frame and the device comprises:

a) a first shaping means for forming the sheets from a flat shape into a U-shape, wherein said U-shape has two vertical side portions and a longitudinal central portion therebetween, and wherein said first shaping means includes:

a gripping means for gripping and accompanying said central portion, wherein said gripping means has lateral support and accompanying elements for rotating said two side portions of said sheets from said flat shape into said U-shape, a pusher element for shaping said central portion into a V-shape, and a first and second endless flat belt extending through and connected to said first shaping means and pulleys for guiding and driving said first and second flat belts, wherein said first and second flat belts face one another and wherein said first flat belt is adapted to receive and support said central portion of said sheets, and said second flat belt is adapted to extend between said side portions of said sheets;

b) a second shaping means including first lateral elements for compacting said V-shaped central portion and folding said sheets, and retaining elements for guiding said folded sheets away from said second shaping means; and c) a support frame for supporting said second flat belt and elastic elements adapted for vertically adjusting said support frame thereby changing the distance between said first and second flat belts.

2. The device of claim 1 further comprising guide rollers supported by said support frame and positioned between said first and second flat belts for guiding said second belt.

3. A device for folding sheets fed in a stream, wherein the device has a frame and the device comprises:

a) a first shaping means for forming the sheets from a flat shape into a U-shape, wherein said U-shape has two vertical side portions and a longitudinal central portion therebetween, and wherein said first shaping means includes:

a gripping means for gripping and accompanying said central portion, wherein said gripping means has lateral support and accompanying elements for rotating said two side portions of said sheets from said flat shape into said U-shape, wherein said lateral support and said accompanying elements comprise mutually facing helically shaped fixed guides positioned on opposite sides of said gripping means, and a pusher element for shaping said central portion into a V-shape; and b) a second shaping means including first lateral elements for compacting said V-shaped central portion and folding said sheets, and retaining elements for guiding said folded sheet away from said second shaping means.

4. A device for folding sheets fed in a stream, wherein the device has a frame and the device comprises:

a) a first shaping means for forming the sheets from a flat shape into a U-shape, wherein said U-shape has two vertical side portions and a longitudinal central portion therebetween, and wherein said first shaping means includes:

a gripping means for gripping and accompanying said central portion, wherein said gripping means has lateral support and accompanying elements for rotating said two side portions of said sheets from said flat shape into said U-shape, wherein said lateral support and said accompanying elements comprise a first and a second endless conveyor belt facing one another and positioned on opposite sides of said gripping means and adapted for forming a helix, wherein the speed of said first and second belt exceed the speed of said gripping means, and a pusher element for shaping said central portion into a V-shape; and b) a second shaping means including first lateral elements for compacting said V-shaped central portion and folding said sheets, and retaining elements for guiding said folded sheet away from said second shaping means.

5. The device of claim 4, wherein said first and said second endless belts have a plurality of holes and wherein the device further comprises box elements having holes and a pump connected thereto, wherein said box element holes complement said endless belt holes, and said box element is adapted for slidingly supporting said endless belts and wherein said pump is adapted for creating a vacuum.

6. A device for folding sheets fed in a stream, wherein the device has a frame and the device comprises:

a) a first shaping means for forming the sheets from a flat shape into a U-shape, wherein said U-shape has two vertical side portions and a longitudinal central portion therebetween, and wherein said first shaping means includes:

a gripping means for gripping and accompanying said central portion, wherein said gripping means has lateral support and accompanying elements for rotating said two side portions of said sheets from said flat shape into said U-shape, and a pusher element for shaping said central portion into a V-shape, wherein said pusher element comprises a guide rod pivotably connected to said gripping means and an elastic element adapted to keep said guide rod horizontal; and b) a second shaping means including first lateral elements for compacting said V-shaped central portion and folding said sheets, and retaining elements for guiding said folded sheet away from said second shaping means.

7. A device for folding sheets fed in a stream, wherein the device has a frame and the device comprises:

a) a first shaping means for forming the sheets from a flat shape into a U-shape, wherein said U-shape has two vertical side portions and a longitudinal central portion therebetween, and wherein said first shaping means includes:

a gripping means for gripping and accompanying said central portion, wherein said gripping means has lateral support and accompanying elements for rotating said two side portions of said sheets from said flat shape into said U-shape, and a pusher element for shaping said central portion into a V-shape, wherein said pusher element comprises a support bar pivotably connected at one end to said gripping means, an idle roller connected to said support bar at an opposite end, and an elastic element adapted for keeping said support bar substantially horizontal; and b) a second shaping means including first lateral elements for compacting said V-shaped central portion and folding said sheets, and retaining elements for guiding said folded sheet away from said second shaping means.

8. A device for folding sheets fed in a stream, wherein the device has a frame and the device comprises:

a) a first shaping means for forming the sheets from a flat shape into a U-shape, wherein said U-shape has two vertical side portions and a longitudinal central portion therebetween, and wherein said first shaping means includes:

a gripping means for gripping and accompanying said central portion, wherein said gripping means has lateral support and accompanying elements for rotating said two side portions of said sheets from said flat shape into said U-shape, and a pusher element for shaping said central portion into a V-shape, wherein said pusher element comprises a support bar pivotably connected at one end to said gripping means, a motorized wheel connected to said support bar at an opposite end, and an elastic element adapted for keeping said support bar substantially horizontal; and b) a second shaping means including first lateral elements for compacting said V-shaped central portion and folding said sheets, and retaining elements for guiding said folded sheet away from said second shaping means.

9. The device of claims 6, 7, or 8 wherein said pusher element further comprises interposed elements attached thereto, adapted for vertically adjusting said pusher element.

10. A device for folding sheets fed in a stream, wherein the device has a frame and the device comprises:

a) a first shaping means for forming the sheets from a flat shape into a U-shape, wherein said U-shape has two vertical side portions and a longitudinal central portion therebetween, and wherein said first shaping means includes:

a gripping means for gripping and accompanying said central portion, wherein said gripping means has lateral support and accompanying elements for rotating said two side portions of said sheets from said flat shape into said U-shape, and a pusher element for shaping said central portion into a V-shape; and b) a second shaping means including first lateral elements for compacting said V-shaped central portion and folding said sheets, and retaining elements for guiding said folded sheet away from said second shaping means wherein said first lateral elements and said retaining elements comprise a first and second motorized belt horizontally facing one another at each side of said vertical side portions of said U-shaped sheet, and support plates transversely adjustably attached to said device, wherein said support plates have end pulleys rigidly attached thereto, wherein said end pulleys are adapted for guiding said first and said second motorized belts, and wherein said support plate comprises a V-shaped entry region open towards and partly laterally embracing said first shaping means, and elastic elements adapted for maintaining said traversal adjustment.

11. A device for folding sheets fed in a stream, wherein the device has a frame and the device comprises:

a) a first shaping means for forming the sheets from a flat shape into a U-shape, wherein said U-shape has two vertical side portions and a longitudinal central portion therebetween, and wherein said first shaping means includes:

a gripping means for gripping and accompanying said central portion, wherein said gripping means has lateral support and accompanying elements for rotating said two side portions of said sheets from said flat shape into said U-shape, and a pusher element for shaping said central portion into a V-shape; and b) a second shaping means including first lateral elements for compacting said V-shaped central portion and folding said sheets, and retaining elements for guiding said folded sheet away from said second shaping means, wherein said first lateral elements and said retaining elements comprise a pair of belts, wherein each belt has a support plate and a pair of substantially L-shaped levers pivotably attached centrally thereto, wherein each of said pair of L-shaped levers on each support plate face one another so that the short arms of the L-shaped levers are side by side each other and wherein each of the long arms of said pair of L-shaped levers have a pulley connected at the end thereof for guiding said pair of belts, and each of the short arms of said pair of L-shaped levers have an elastic element connected thereto for urging the short arms apart from one another.

12. The device of claim 11, wherein each of said long arms of said pair of L-shaped levers further comprise at least one idle roller attached thereto for guiding each belt.

13. The device of claim 11, wherein each of said long arms of said pair of L-shaped levers further comprise guide rollers yieldable attached thereto for guiding each belt.

14. The device of claims 1, 3, 4, 6, 10, or 11 further comprising, a third shaping means for receiving said folded sheets from said second shaping means and for rotating said folded sheet 90°; wherein said third shaping means includes second lateral elements for retaining and guiding said rotated folded sheets wherein said first and said second lateral elements are adapted for separating edges of said sheets, one form another; and conveyor means supported by the frame and positioned upstream of said first shaping means for feeding said sheets thereto, positioned between said first and said second shaping means for feeding said sheets therebetween, positioned between said second and said third shaping means for feeding said sheets therebetween, and positioned downstream of said third shaping means for discharging said folded sheets therefrom.

15. The device of claim 14, wherein said second lateral elements of said third shaping means comprise a pair of belts for engaging an intermediate region of said vertical side portions of said U-shaped sheets, wherein one end of said pair of belts is aligned with the exit of said retaining elements of said second shaping means and the other end of said pair of belts is helically rotated 90° for rotating said sheets.

16. The device of claim 15, wherein each of said other end of said pair of belts comprise two motorized pulleys one above the other for horizontal rotation thereof, and elastic elements vertically yieldably connected to said motorized pulleys.

17. The device of claim 16, wherein said third shaping means comprises a pair of belts and pulleys for rotation thereof and wherein said two motorized pulleys have a second set of belts thereon and horizontally facing each other, wherein said second set of belts are adapted for transmitting rotary motion to said pulleys of said third shaping means.

18. A device for folding sheets fed in a stream, wherein the device has a frame and the device comprises:

a) a first shaping means for forming the sheets from a flat shape into a U-shape, wherein said U-shape has two vertical side portions and a longitudinal central portion therebetween, and wherein said first shaping means includes:

a gripping means for gripping and accompanying said central portion, wherein said gripping mean has lateral support and accompanying elements for rotating said two side portions of said sheets from said flat shape into said U-shape, and a pusher element for shaping said central portion into a V-shape wherein said lateral support comprises a pair of horizontally facing belts diverging in a V-shape towards said pusher element, a pair of slides attached to the device, pulleys vertically pivotably attached to said pair of slides for guiding said belts thereon, and elastic elements operatively connected to said pulleys for maintaining mutual engagement thereof; and b) a second shaping mean including first lateral elements for compacting said V-shaped central portion and folding said sheets, and retaining elements for guiding said folded sheets away from said second shaping means.

19. The device of claim 18 wherein said pair of slides comprises adjustment means for vertically and horizontally adjusting the position thereof, and wherein said pulleys further comprise motor means operatively attached thereto for driving said pulleys.

20. A device for folding sheets fed in a stream, wherein the device has a frame and the device comprises:

a) a first shaping means for forming the sheets from a flat shape into a U-shape, wherein said U-shape has two vertical side portions and a longitudinal central portion therebetween, and wherein said first shaping means includes:

a gripping means for gripping and accompanying said central portion, wherein said gripping means has lateral support and accompanying elements for rotating said two side portions of said sheets from said flat shape into said U-shape, and a pusher element for shaping said central portion into a V-shape; and b) a second shaping means including first lateral elements for compacting said V-shaped central portion and folding said sheets and retaining elements for guiding said folded sheets aways from said second shaping means; and c) a drive motor operatively attached longitudinally to the device and a drive shaft attached to said drive motor, wherein said gripping means, said lateral support, and said accompanying elements of said first shaping means are operatively connected to said drive shaft.

21. The device of claim 20 wherein said second lateral elements are operatively connected to said drive shaft.

22. The device of claim 14, wherein said conveyor means further comprises a pusher conveyor operatively connected thereto.

23. The device of claim 14, wherein said lateral support and said accompanying elements of said first shaping means are vertically mobile.

24. The device of claim 14 wherein said first endless flat belt comprises a toroidal shape.

* * * * *